US011369857B2

(12) United States Patent
Histed et al.

(10) Patent No.: US 11,369,857 B2
(45) Date of Patent: Jun. 28, 2022

(54) POLISHING APPARATUS

(71) Applicant: JRC INNOVATION LIMITED, Kent (GB)

(72) Inventors: Jonathan Rosser Histed, Kent (GB); Robin Craig Cocker, Kent (GB); Paul Christopher Edward Mutti, Lincolnshire (GB)

(73) Assignee: JRC INNOVATION LIMITED, Kent (GB)

( * ) Notice: Subject to any disclaimer, the term of this patent is extended or adjusted under 35 U.S.C. 154(b) by 885 days.

(21) Appl. No.: 16/075,331

(22) PCT Filed: Feb. 3, 2017

(86) PCT No.: PCT/GB2017/050279
§ 371 (c)(1),
(2) Date: Aug. 3, 2018

(87) PCT Pub. No.: WO2017/134458
PCT Pub. Date: Aug. 10, 2017

(65) Prior Publication Data

US 2019/0038957 A1 Feb. 7, 2019

(30) Foreign Application Priority Data

Feb. 5, 2016 (GB) ..... 1602164

(51) Int. Cl.
*B24B 3/00* (2006.01)
*B24B 41/06* (2012.01)
(Continued)

(52) U.S. Cl.
CPC ..... *A63C 3/10* (2013.01); *B24B 3/003* (2013.01); *B24B 9/04* (2013.01); *B24B 23/005* (2013.01);
(Continued)

(58) Field of Classification Search
CPC .. A63C 3/10; B24B 3/003; B24B 9/04; B24B 23/005; B24B 23/04; B24B 41/06;
(Continued)

(56) References Cited

U.S. PATENT DOCUMENTS 555,974 A 3/1896 Roberts et al.
750,696 A * 1/1904 Price ..... A63C 11/06 76/83

(Continued)

FOREIGN PATENT DOCUMENTS

| | | |
|---|---|---|
| CA | 984611 | 3/1976 |
| CA | 1159484 | 12/1983 |
| DE | 29801824 | 10/1998 |

OTHER PUBLICATIONS

International Search Report and Written Opinion dated Jul. 12, 2017, from International Application No. PCT/GB2017/050279, 18 pages.

(Continued)

*Primary Examiner* — Eileen P Morgan
(74) *Attorney, Agent, or Firm* — Meunier Carlin & Curfman LLC

(57) ABSTRACT

The invention relates to apparatus for polishing a running base that comprises a blade with two opposing blade edges separated one from the other by an intermediate section; the polishing apparatus comprising: a support body, and blade alignment guide means; wherein the support body is capable of carrying a polishing surface which comprises: a profile which is adapted to conform with one or more portions of the intermediate section; and wherein the blade alignment guide means comprise one or more pairs of first and second blade alignment guides, which first and second blade alignment guides in each pair are separated from each other by the polishing surface, and further wherein the blade alignment guide means is adapted to receive and/or guide and/or
(Continued)

constrain a running base so that when the intermediate section between the two edges of the running base is brought into contact with the polishing surface, there is no contact between the polishing surface and any part of the two opposing blade edges of the running base.

9 Claims, 10 Drawing Sheets

(51) Int. Cl.

| | |
|---|---|
| ***B24B 9/04*** | (2006.01) |
| ***B24D 15/04*** | (2006.01) |
| ***B24D 15/06*** | (2006.01) |
| ***A63C 3/10*** | (2006.01) |
| ***B24B 23/00*** | (2006.01) |

(52) U.S. Cl.
CPC ..... *B24B 41/06* (2013.01); *B24D 15/04* (2013.01); *B24D 15/06* (2013.01); *B24D 15/066* (2013.01); *A63C 2203/12* (2013.01)

(58) Field of Classification Search
CPC ..... B24D 15/04; B24D 15/06; B24D 15/066; B24D 15/08
USPC ... 451/45, 59, 164, 168, 371, 386, 387, 383, 451/391, 405, 490, 523
See application file for complete search history.

(56) References Cited

U.S. PATENT DOCUMENTS

| | | | | |
|---|---|---|---|---|
| 2,042,916 | A | 6/1936 | Viozzi | |
| 3,108,410 | A | 10/1963 | Matuszek | |
| 3,164,932 | A | 1/1965 | Morith | |
| 3,881,280 | A * | 5/1975 | Thompson | B24B 3/003 451/241 |
| 4,815,240 | A | 3/1989 | Larson | |
| 5,239,785 | A | 8/1993 | Allen | |
| 5,445,050 | A | 8/1995 | Owens | |
| 5,591,069 | A * | 1/1997 | Wurthman | B24D 15/066 451/193 |
| 7,517,275 | B2 * | 4/2009 | Friel, Sr. | B24D 15/08 451/198 |
| 8,267,750 | B2 * | 9/2012 | Friel, Sr. | B24D 15/08 76/84 |
| 8,851,961 | B2 * | 10/2014 | Frommer | A63C 11/08 451/410 |
| 8,944,889 | B2 * | 2/2015 | Frommer | B24B 3/003 451/45 |

OTHER PUBLICATIONS

International Preliminary Report on Patentability dated May 11, 2018, from International Application No. PCT/GB2017/050279, 23 pages.
Extended European Search Report in related Application No. EP21198096 dated Jan. 14, 2022.

* cited by examiner

POLISHING APPARATUS

FIELD OF THE INVENTION

The present invention is concerned with polishing apparatus, particularly for improving the performance of a running base and further particularly for improving the speed and gliding characteristics of running bases when they run over water, snow or ice surfaces or artificial materials that mimic these surfaces.

BACKGROUND OF THE INVENTION

There are many examples of running bases for running over water, snow or ice and artificial materials that mimic these surfaces, including all types of skis, surf boards, snowboards, toboggans, bob sleighs, dog sleds, luge sleds, snow mobiles, snow bikes and all types of bladed ice skates.

Ice skating, in one of form or another, has been around for many centuries with animal bones and wood being fixed to the base of boots and used as runners long before the discovery of metal. Today's ice skates appear deceptively simple, a metal blade fixed to the sole of a boot, but there is far more subtlety in the engineering for this than meets the eye.

Firstly, the overall shape of the ice skate blade is chosen to suit the type of ice skating that is to be performed, for example ice hockey, ice dancing, bandy skating, figure skating and speed skating. Figure and dance skates generally include a toe pick to assist in jumps, spins and stops, and have a short tail at the back. The base of the figure and dance blade is also slightly curved toe to heel (the rocker), and has a radius of curvature of about 2 m. Hockey skates, on the other hand, are designed for speed and maneuverability and are generally shorter than figure blades and are without a toe pick or tail. Their rocker is also flatter, toe to heel, with a larger radius of curvature of typically between 3.35 and 3.96 m. Speed-skates are different again; these are considerably longer than figure and hockey skates, and are substantially flat, toe to heel, i.e. they have no rocker at all.

Secondly, unlike the blade of a knife, the bottom of a running base has two opposing sharp edges along its length. These opposing sharp edges are separated one from the other by an intermediate section. In the case of skis, surf boards, snowboards, toboggans, bob sleighs, dog sleds, luge sleds, snow mobiles, snow bikes and speed skates this intermediate section is substantially flat, and in the case of other types of ice skates, e.g. figure, bandy and hockey skates, this intermediate section is traditionally a crescent-shaped hollow that is ground into the underside of the skate blade. In all of the abovementioned running bases, the opposing sharp edges are created by the two extreme points of the intermediate section, be it flat or crescent shaped. When the hollow is crescent shaped also its depth is varied depending on whether the blade is going to be used for figure or hockey skating. The depth is determined by the radius of hollow (ROH), with a deeper hollow being produced by a smaller ROH; this achieves more grip, as required by figure skaters, and figure skate blades typically have a ROH in the range 11.11 to 15.9 mm. Hockey skate blades generally need to be faster, so the hollow is shallower and the radius of hollow (ROH) is larger, typically 25.4 to 50.8 mm.

To ensure that a running base is able to give optimum performance, it is important to maintain well-sharpened blade edges. This is typically achieved using a jig to hold the running base still, and for running bases with substantially flat intermediate section, sharpening is achieved by rubbing a flat sharpening stone across the intermediate section and the blade edges of the running base. For hollow ground running bases one uses a rotating abrasive wheel, dressed with an abrasive material such as silicon carbide or aluminium oxide, to re-grind both the intermediate section and, crucially, the edges, so as to provide a pair of opposing sharpened blade edges. However, these grinding operations are relatively expensive, and the blade edge does not stay sharp for very long before another regrind has to be performed. Furthermore, the re-grind process removes relatively large amounts of metal from the blade and repeated re-grinding wears the running base very quickly and this, of course, means that new blades need to be bought on a frequent basis. Another problem, particularly for hollow ground skates is that due to the coarseness of the abrasive used, re-grinding leaves the surface of the intermediate section in a rough condition, with pronounced ridges and scratches which interfere with the ability of the underside of the blade, particularly the hollow or the intermediate section, to run smoothly over the ice.

This problem is apparently overcome by U.S. Pat. No. 5,239,785 which describes a method and tool for finishing sharpened skate blades, involving rubbing all of the sharpened skate blade surfaces (i.e. the intermediate section) and the sharpened edges, against a strip of leather. However, because both of the blade edges as well as the hollow (the intermediate section) are contacted with the leather, problems are caused such as the dulling of the sharpness of the two opposing blade edges. U.S. Pat. No. 3,164,932 suffers a similar problem, as does U.S. Pat. Nos. 4,815,240 and 5,445,050.

Canadian patent document CA1159484A1 describes polishing the ice engaging surface of the blade which is intermediate the side edges of the blade, to achieve a mirror-finish. Unlike the prior art discussed above, this Canadian method appreciates the need to avoid polishing the edges of the blade in order to maintain their sharpness. However, problems using the described apparatus are still likely to occur: in particular, the polishing element described in CA1159484A1 has a circumferential edge with a relatively small width in order to avoid contact with the two opposing blade edges of the blade, but this will make it difficult for the operator to control the polishing element within the ground hollow and it is very likely that it will slip round and inadvertently contact the edges of the blade. Moreover, the apparatus as described, is clearly for use on a workbench or the like and is not adapted to be used by the skater at the ice rink.

The aim of the present invention is to provide apparatus which is cost effective to produce and quick and easy to use. A key purpose of the present invention is enable the intermediate section between the two opposing blade edges of a running base and particularly of any ice skate blade (i.e. not limited to a figure or ice dance skate, a hockey or bandy skate or a speed-skate) to be evenly, controllably and reliably polished, whilst at the same time at least substantially, and preferably completely, avoiding doing anything that would cause detriment to the two opposing blade edges of the blade. Advantageously, the apparatus of the present invention will comprise controlling means to control the orientation of the polishing apparatus relative to the intermediate section, for example, the apparatus of the present invention will be able to be easily and reliably centred between the blade edges. It is also an aim of the present invention to provide apparatus that is capable of delivering a degree of polishing that is superior to that conventionally delivered by prior art polishing apparatus. It is yet another aim to produce apparatus which includes a polishing surface that can be easily renewed to ensure the re-use and longevity of the polishing apparatus of the present invention.

It is a further aim of the present invention to provide polishing apparatus which is convenient for a skater to use at the side of the ice rink, particularly without the need for extra specialist tooling, clamps or a work bench, although the polishing apparatus can be adapted for use (e.g. mounted) on a work bench or similar if desired. Moreover, the present invention aims to provide apparatus that can be operated entirely manually. In an alternative version the polishing apparatus can be largely manually operated with additional electrically driven vibration or reciprocal motion to enhance the performance of the polishing apparatus. In a further alternative version the polishing apparatus can be entirely electrically operated.

STATEMENT OF THE INVENTION

In the first embodiment, the present invention therefore provides a polishing apparatus, preferably a hand held apparatus, for treating a running base that comprises a blade with two opposing blade edges separated one from the other by an intermediate section; the polishing apparatus comprising:

- a support body, and blade alignment guide means;
- wherein the support body is capable of carrying a polishing surface which comprises:
  - a profile which is adapted to conform with one or more portions of the intermediate section which separates the two opposing blade edges; and
  - wherein the blade alignment guide means comprise one or more pairs of first and second blade alignment guides which first and second blade alignment guides in each pair are separated from each other by the polishing surface; and
  - further wherein the blade alignment guide means is adapted for receiving, guiding and constraining a running base to ensure that when the polishing surface and the intermediate section between the two opposing blade edges of the received running base are brought into contact with one another, there is no contact between any portion of the polishing surface and any part of the two opposing blade edges of the running base.

Preferably, the polishing surface is configured such that when it is in contact with the one or more portions of the intermediate section, there is no simultaneous contact between the polishing surface and the two opposing blade edges. Further preferably, the polishing surface fits between the two opposing blade edges. Yet further preferably, the dimension of the polishing surface which extends between the two opposing blade edges is no larger (i.e. it is the same or smaller) than the dimension of the intermediate section which extends between the two opposing edges.

The intermediate section which separates the opposing blade edges may be at least substantially flat, as found, for example in speed skate blades, certain designs of hockey skates, toboggans, bob sleds, dog sleds, skis, snow boards, surf boards, snow mobiles and snow bikes. In a preferred embodiment, the intermediate section may be formed by a hollow ground in the base of a skate blade. The hollow may be have a curved or concave surface, such as rounded or semi-circular, and as discussed above, this type of profile, i.e. with a radius of hollow, is typically used on figure, dance, bandy and traditional hockey ice skates. More recently however, hollows with straight edge sections in their profile have been developed, for example for ice hockey skates. These new hollow profiles typically comprise a flat base region, and examples include the BFD™ profile developed by Blackmaster, and the Flat bottom V™ profile developed by Blackstone Sports. However, all profiles of hollow and intermediate section are able to be polished using the polishing apparatus of the present invention, no matter what type of running base is being polished.

In a second embodiment, the invention provides polishing apparatus for treating a running base that comprises a hollow ground blade, the polishing apparatus comprising:

- a support body, and blade alignment guide means;
- wherein the support body is capable of carrying a polishing surface which comprises:
  - a profile which is adapted to conform with one or more portions of the hollow ground in a running base;
  - wherein the blade alignment guide means comprise one or more pairs of first and second blade alignment guides which first and second blade alignment guides in each pair are separated from each other by the polishing surface and further wherein the blade alignment guide means is adapted for receiving, guiding and constraining an running base to ensure that when the polishing surface and the hollow ground between the two opposing blade edges of the running base are brought into contact with one another, there is no contact between any portion of the polishing surface and any part of the two opposing blade edges of the running base.

Preferably, the polishing surface is configured such that when it is in contact with the one or more portions of the intermediate section, there is no simultaneous contact between the polishing surface and the two opposing blade edges. Further preferably, the polishing surface fits between the two opposing blade edges. Yet further preferably, the dimension of the polishing surface which extends between the two opposing blade edges is no larger (i.e. it is the same or smaller) than the dimension of the intermediate section which extends between the two opposing edges.

It will be appreciated that the polishing apparatus of the present invention is in no way similar to the coarsely dressed grinding wheels which are used to sharpen running bases, for example ice skate blades; moreover, it is clear that the polishing apparatus of the present invention treats a running base to produce a very different end result from the dressed grinding wheel. As discussed above, a dressed grinding wheel is used to remove relatively large quantities of metal from all areas of the underside of a running base (particularly an ice skate blade), i.e. the intermediate section, the hollow ground in the blade and also the two opposing blade edges of the running base. Further, the principal purpose of using a dressed grinding wheel is to sharpen the two opposing blade edges of a running base by re-grinding the radius of hollow. By contrast, the apparatus of the present invention preferably removes only minimal amounts of metal from the intermediate section of the running base, to produce an intermediate section with a surface which is smooth, i.e. not rough, and preferably mirror polished.

As noted above, an essential feature of the polishing apparatus of the present invention is that when a running base is received by the blade alignment guide means and guided to enable the intermediate section to contact the polishing surface, there is no contact between the polishing surface and any part of the two opposing blade edges. In this way, the two opposing blade edges of the running base are not harmed or dulled by the polishing apparatus of the present invention and the quality of the lateral grip between the running base (specifically the two opposing blade edges)

and running surface (snow or ice) can be maintained. Another essential feature is the provision of blade alignment guide means which comprise one or more pairs of first and second blade alignment guides. Preferably, the first and second blade alignment guides in each of the one or more pairs, cooperate together to form one or more zones (edge relief zones), which may be in the form of channels or slots. The one or more pairs of first and second blade alignment guides are adapted to receive guide and constrain the running base so that the two opposing blade edges are received within the edge relief zones during use of the polishing apparatus of the present invention. Preferably the one or more edge relief zones are axially aligned parallel with the longitudinal axis of a received running base.

The one or more pairs of first and second blade alignment guides are also useful to receive a running base and to guide and constrain the running base so that the intermediate section which separates and is preferably between the two opposing blade edges is correctly oriented to be in contact with the polishing surface, but without any part of the two opposing blade edges of the running base also being contacted by the polishing surface. To further ensure that the two opposing blade edges of the running base are undamaged by the polishing apparatus, it is preferred that as well as the blade edges not coming into contact with any part of the polishing surface, the blade edges will preferably not come into contact with any of the one or more pairs of first and second blade alignment guides, and/or the support body, and/or any part of the polishing apparatus which is made of a material that is harder than the blade, and/or any material which causes detriment to two opposing edges of the blade. In addition, the apparatus of the present invention preferably further comprises blade edge relief means, which preferably comprises first and second blade edge relief zones, which may be in the form of channels. Importantly, the first and second blade edge relief zones do not comprise any part of the polishing surface. Preferably, the first blade edge relief zone is disposed intermediate between a first blade alignment guide in a pair of alignment guides and the polishing surface, and the second blade edge relief zone is disposed intermediate between a second blade alignment guide in the same pair of alignment guides and the polishing surface; and wherein the first blade edge relief zone is adapted to receive one of the two opposing blade edges of the running base, and the second blade edge relief zone is adapted to receive the other of the two opposing blade edges of the running base.

Further preferably, the polishing apparatus according to the present invention has a polishing surface that also comprises one or more raised elements which protrude from the polishing surface. Ideally the raised elements are configured to conform to the shape of one or more portions of the intermediate section, such that when the polishing surface and the intermediate section are brought into contact with one another, and there is no contact between the polishing surface (or the one or more raised elements) and any part of the two opposing blade edges of the running base.

Advantageously, the present invention provides a polishing apparatus as described above, wherein the polishing surface further comprises a polishing material disposed on the support body. The polishing material may comprise any material which provides performance enhancement benefits to a running base. This can include but is not limited to a burnishing material, a cutter, a layer of silica, diamond, aluminium oxide, silicon carbide, emery (impure corundum), calcite, calcium carbonate, aluminium oxide, silicon carbide, silicon dioxide or cerium oxide, lapping abrasives, polishing and/or abrasive in a paste, or a liquid form or a grinding compound disposed on the support body. The support body may be made of any suitable material, such as a polymer, and the polishing material may be adhered to or embedded into the surface of the support body.

Alternatively, the polishing surface comprises a coating of a polishing material disposed on a first surface of one or more substrate bodies, to produce one or more coated substrate bodies which are adapted to be carried by the support body. Optionally, one or more of the coated substrate bodies is removable from the support body, and further optionally one or more coated substrate bodies is replaceable with one or more further similar coated substrate bodies. When carried by the support body, the one or more coated substrate bodies are oriented so that their coated surface (i.e. the polishing surface) is directed away from the support body.

Conveniently, the one or more coated substrate bodies described above comprise one or more sheets coated on a first surface (or side) with the polishing material (hereafter, "coated sheets"). The coated sheet may also comprise a non-coated second surface (or side) (hereafter referred to as the "non-coated surface"). Alternatively, the coated substrate body may comprise a coated continuous loop of substrate material, for example of the type used in a belt sanding or polishing machine. Further alternatively, the coated substrate body is a coated circumferential rim of a polishing wheel.

Preferably, at least one of the coated sheets comprises a pattern, for example, of one or more elements (which may or may not be interlocking and which may or may not be in the form of fingers) which is cut into it. When opposing edges of the at least one cut coated sheet is folded in a direction sub-horizontally away from its coated first surface (hereafter referred to as the "coated surface"), the one or more elements are caused to protrude from, or extend out of the plane of, the coated surface of the folded coated sheet to thereby form one or more raised (or protruding) elements which are adapted to engage with one or more portions of the intermediate section of the running base and, critically, not any part of the two opposing blade edges of the running base when a running base is received by the blade alignment guide means.

Ideally, the raised or protruding elements are resiliently deformable when they engage one or more portions of the intermediate section. The pattern of elements is conveniently cut into the at least one of the plurality of sheets of coated material using any known manually or mechanically operable cutting means, for example scissors, scalpel blade, guillotine, water jet cutting, a punching machine or laser cutting machine.

Advantageously, the polishing apparatus according to the present invention comprises one or a plurality of coated sheets which are overlaid one on top of each other in a stack which is carried by the support body. The coated first side of each coated sheet in the stack is directed away from the support body and the coated first surface of the coated sheet stacked furthest away from the support body forms the polishing surface. Preferably, this means that the polishing surface is formed by the coated first surface of the topmost sheet of coated material in the stack. The coated sheet stacked furthest away from the support body (preferably the topmost sheet in the stack) is individually removable from the stack to reveal the next successive coated sheet in the stack. Preferably the coated first surface of this successive coated sheet forms a new polishing surface. In this arrangement, the operator of the polishing apparatus is able to replenish the polishing surface and to ensure that both the cartridge and the polishing apparatus maintain their performance.

Preferably, all of the plurality of coated sheets are dimensionally similar to each other and when carried by the support body are all oriented in similar alignment with each other.

Preferably, the polishing material disposed on the first surface of the top most (the sheet stacked furthest away from the support body) coated sheet in the stack may either be the same as or different from the polishing material disposed on successive coated sheets. Further, the particle size of the polishing material disposed on the coated topmost and successive sheets, can be in ascending, descending or random order. Advantageously, the polishing material coated on the first surface of the topmost sheet in the stack is more abrasive than the next successive coated sheet in the stack. Further preferably, the polishing material coated on the first surface of the topmost sheet is a coarser abrasive than the next successive coated sheet in the stack.

Advantageously, the one or more coated sheets are each associated with removal facilitation means to facilitate the removal of each coated sheet from the support body. In the case where more than one coated sheet is collated in a stack on the support body, the removal facilitation means facilitates the removal of the topmost coated sheet in the stack, preferably without simultaneously removing any of the successive coated sheets in the stack.

Most advantageously, removal facilitation means is associated with each of the one or more coated sheets and comprises a finger operable tab. In use, the operator grips a finger operable tab associated with one of the coated sheets (e.g. the coated sheet stacked furthest away from the support body i.e. the topmost sheet), between thumb and fore finger, and pulls the gripped finger operable tab and its associated coated sheet in a direction away from the support body. By this method, the coated sheet stacked furthest away from the support body (the topmost sheet) may be torn from the stack to reveal the coated first surface of the next successive coated sheet.

The polishing apparatus of the present invention operates particularly effectively when the polishing surface is associated with resilient means for resiliently deflecting the polishing surface towards the intermediate section to enable engagement or contact between the two. Preferably, the resilient means comprises a deformable material positioned between the support body and the non-coated surface of a coated sheet. Suitable deformable materials include rubber or similar. As an alternative, particularly but not exclusively, when the polishing surface comprises a layer of polishing material disposed on the support body, the support body itself may comprise a deformable material of the type described above.

Preferably, the polishing apparatus according to the present invention comprises one or more coated substrate bodies which are attached to the support body using substrate body attachment means. The coated substrate bodies should be held securely so that the coating cannot move relative to the support body, i.e. if the support body moves, the abrasive moves too. This ensures efficient polishing. The substrate body attachment means can include any arrangement that is adapted to maintain and/or hold and/or grip the one or more coated substrate bodies in place on the support body, for example whilst the polishing apparatus is in use. Example substrate body attachment means include, for example, stapling, hook and loop fastening tape, sewing, welding, ultrasonic welding, riveting, one or more clips, heat staking and adhesive.

When the one or more coated substrate body comprises one or more coated sheets, they will preferably each comprise at least one edge which is adapted to be engaged by the substrate body attachment means. Ideally, the substrate body attachment means will comprise one or more clips, for example in the form of posts and/or barbs, which are adapted to engage with the one or more coated sheets. In the case where a stacked plurality of coated sheets is used, each of the coated sheets in the stack will comprise a first edge which is aligned with a corresponding first edge in all of the coated sheets in the stack. Advantageously, this alignment of first edges enables attachment of the stack to the support body using a single substrate body attachment means e.g. the abovementioned clips. Multiple substrate body attachment means may also be used.

Preferably, at least one of the one or more coated sheets carried by the support body is under tension. This is advantageous i) because loose abrasive may migrate or spread laterally to the extent that it touches and dulls the edges of a running base, so it is important to control where the abrasive material is on the polishing surface ii) it ensures that the substrate body and therefore the polishing surface is able to adopt the desired profile, iii) it enables an efficient contact between the polishing surface and one or more portions of the intermediate section. Also, when the coated sheets are under tension, a cut pattern of elements which form the polishing surface (as described above) protrudes more effectively from the first surface of the coated sheet.

To operate the polishing apparatus to treat a running base (such as an ice skate blade), it is necessary first to insert a running base between the one or more pairs of first and second blade alignment guides such that the polishing surface makes contact with, or engages with, the intermediate section between the two opposing blade edges. The first and second blade alignment guides are adapted to constrain the running base (ice skate blade) so that the polishing surface does not make any contact with the two opposing blade edges. Whilst the polishing surface is in contact with the intermediate section, the polishing surface and the intermediate section are then caused to move relative to each other. For example, the running base and/or the polishing apparatus may be moved in long or short strokes back and forth, preferably along the full length of the intermediate section of the running base blade, between the forward and rearward ends of the running base blade. This relative movement may at least in part be achieved manually by the operator, or by an automated system. The polishing apparatus of the present invention is particularly effective when the polishing surface and the intermediate section are moved relative to each other in single strokes reciprocating between the forward and rearward ends of the blade. In addition, or alternatively, an actuation device may be used for driving vibratory motion (e.g. short strokes of reciprocating motion) which causes the polishing surface and the intermediate section to move in short reciprocating motion relative to each other. Suitable actuation devices include a solenoid, pneumatic, clockwork, hydraulic, a winding handle, a friction wheel driven off the running base or associated surfaces, any motor and any other form of power. An external low voltage power source may be used for example a charger which plugs directly into the mains to provide the power, or alternatively a low voltage charger could be used to recharge one or more batteries held internally within the polishing apparatus. Preferably the invention further comprises coupling means for coupling the support body to the actuation device.

The polishing apparatus as described above, wherein the actuation device further comprises coupling means, for example comprising a drive dog and wherein the support body further comprises a drive dog receiving means, wherein the drive dog receiving means is adapted for receiving and retaining the drive dog.

A polishing apparatus according to the present invention wherein the polishing surface is capable of polishing at least a portion of the intermediate section, up to but not including (i.e. without any contact being made with) the two opposing blade edges of a running base.

In a third embodiment, the present invention further provides a method of using the polishing apparatus described above to treat a running base that has a blade with two opposing blade edges separated one from the other by an intermediate section, comprising the steps:

i) inserting a running base between the one or more pairs of first and second blade alignment guides such that the polishing surface makes contact with the intermediate section;

ii) causing relative movement between the polishing surface and the intermediate section, preferably substantially along the full length of the blade; and iii) continuing step ii) for at least 1 second, and preferably for up to 1 minute preferably for up to 2 minutes until the intermediate section between the opposing blade edges of the running base is treated, preferably to obtain a polished mirror finish and further preferably treated to the extent necessary to observe an improvement in the performance of the running base.

Preferably, the present invention provides a method of using the polishing apparatus described above to treat a running base that has a blade with two opposing blade edges separated one from the other by an intermediate section, comprising the steps:

i) inserting a running base between the one or more pairs of first and second blade alignment guides such that the polishing surface makes contact with the intermediate section;

ii) causing relative movement between the polishing surface and the intermediate section, preferably substantially along the full length of the blade;

iii) continuing step ii) for at least 1 second and preferably for up to 1 minute and further preferably for up to 2 minutes;

iv) removing the running base from between the one or more pairs of first and second blade alignment guides and removing from a stack of sheets of coated material carried by the support body, a sheet of coated material which is stacked furthest away from the support body, to reveal a next successive sheet of coated material in the stack; and v) repeating steps i), ii) and iii); and optionally vi) repeating steps iv) and v).

Preferably, steps iv) and v) are repeated until the intermediate section is treated to obtain a polished mirror finish and further preferably treated to the extent necessary to improve the performance of the running base.

Further preferably, the present invention provides a method of using the polishing apparatus described above for treating a running base that has a blade with two opposing blade edges separated one from the other by an intermediate section, comprising the steps:

i) inserting an running base between the one or more pairs of first and second blade alignment guides until the polishing surface makes contact with the intermediate section;

ii) engaging the actuation device to drive reciprocating (e.g. vibratory) motion of the polishing surface relative to the running base;

iii) causing relative movement between the polishing surface and the and the intermediate section, preferably substantially along the full length of the blade;

iv) continuing step iii) for at least 1 second, preferably for up to 1 minute and further preferably for up to 2 minutes until the intermediate section between the edges of the running base blade is treated;

v) removing the running base blade from between the one or more pairs of first and second blade alignment guides, disengaging the actuation device and removing from a stack of sheets of coated material carried by the support body, a sheet of coated material stacked furthest away from the support body to reveal a next successive sheet of coated material in the stack; and vi) repeating steps i), ii), iii) and iv); and optionally vii) repeating steps v) and vi).

Preferably, the polishing apparatus of the present invention is a hand held device; alternatively the polishing apparatus may be mounted, for example on a work bench or similar.

Further preferably, each of the alignment guides upstand perpendicular relative to the longitudinal axis of the support body. Further, the two opposing alignment guides in the first pair are separated one from the other by a distance greater than the width of the top portion of the support body at its forward end and the two opposing alignment guides in the second pair are separated one from the other by a distance greater than the width of the top portion of the support body at its rearward end.

Advantageously, the method of treating a running base in accordance with the present invention yields significant and measurable improvements in the performance of the running base. Performance improvement can be categorised by the skater in several ways including, but not limited, to an improvement in the glide quality and speed performance, the efficiency of the skate to convert work done into work output.

The action of "treating" a running base blade preferably involves polishing the blade, particularly the intermediate section between the two opposing blade edges, so as to create a smooth, preferably mirrored, finish. In particular, the treatment achieved by the apparatus of the present invention preferably at least reduces and further preferably removes, the scratches and roughness which in the case of an ice skate are left on the intermediate section of an ice skate blade as a result of it being sharpened using a dressed grinding wheel.

As noted above, the intermediate section may comprise the base of the hollow that is ground in the running base. When this is the case, step i) of the process of the present invention preferably involves inserting a running base between the first and second blade alignment guides until the polishing surface makes contact with the base of the hollow. The wording "base of the hollow" is to be understood as referring to either the portion of the crescent shape (in the case of a hollow with a circular profile), or the portion of the flat base for example in BFD™ or Flat bottom V™ profiles as described above, which is around the midpoint of the hollow between but not including the two opposing blade edges of the ice skate blade.

In a fourth embodiment, the present invention also provides a running base that has been treated using the polishing apparatus described above.

In a particularly preferred arrangement of the polishing apparatus of the present invention, the support body is removable from the polishing apparatus. Thus, in a preferred fifth embodiment, the present invention provides a cartridge for use in and preferably removable from the polishing apparatus for treating a running base that comprises a blade with two opposing blade edges separated one from the other by an intermediate section, as described above, wherein the cartridge comprises:

a support body and blade alignment guide means;

wherein the support body is capable of carrying a polishing surface which comprises:

a profile which is adapted to conform with one or more portions of the intermediate section;

and wherein the blade alignment guide means comprise one or more pairs of first and second blade alignment guides, wherein first and second alignment guides in each one or more pairs are separated from each other by the polishing surface, and further wherein the blade alignment guide means is adapted to receive, guide and constrain an ice skate blade so that when the polishing surface and the intermediate section between the two opposing blade edges of the ice skate blade are brought into contact with one another, there is no contact between any portion of the polishing surface and any part of the two opposing blade edges of the running base blade.

A preferred cartridge according to the present invention comprises blade edge relief means or zone for ensuring that no part of the two opposing blade edges of the ice skate blade come into contact with any of i) the polishing surface, ii) the one or more pairs of first and second blade alignment guides and iii) the support body, when the polishing surface and the intermediate section between the two opposing blade edges of the running base are brought into contact with one another. The blade edge relief means comprises first and second blade edge relief channels which comprise no part of i) the polishing surface, ii) the one or more pairs of first and second blade alignment guides or iii) the support body, wherein a first blade edge relief means is located intermediate between the one or more first blade alignment guides and the polishing surface, and a second blade edge relief channel is located intermediate between the one or more second blade alignment guides and the polishing surface, and further wherein the first blade edge relief channel is adapted to receive one of the two opposing blade edges of the ice skate blade, and the second blade edge relief channel is adapted to receive the other of the two opposing blade edges of the ice skate blade.

The features and alternatives described above, particularly in relation to the support body, the blade alignment guides, the polishing surface, the polishing material, the coated substrates, the removal facilitation means, the resilient means and the substrate body attachment means, are all directly applicable to use in relation to the cartridge.

Preferably the present invention provides a cartridge in which the support body further comprises coupling means for coupling the support body to an actuation device, of the type described above, which is adapted to drive reciprocating (vibratory) motion of the polishing surface relative to a running base blade.

In a sixth embodiment, the present invention provides polishing apparatus for polishing an running base which comprises two opposing blade edges separated one from the other by an intermediate section, wherein the polishing apparatus comprises:

blade alignment guide means, as described above, a support body capable of carrying a polishing surface, as described above, which support body is optionally removable, and a polishing surface alignment system;

wherein the polishing surface alignment system is adapted to provide an alignment between the polishing surface and the intermediate section which is independent of the alignment between the running base and the exterior or mounting datum of the polishing apparatus about an axis parallel to the axis of the skate blade as a whole.

Particularly preferably, the present invention provides a seventh embodiment of a polishing apparatus for polishing a running base that comprises a blade with two opposing blade edges, separated one from the other by an intermediate section, the polishing apparatus comprising:

a body housing comprising a first and a second opposing side wall and a third base wall which extends between and links the first opposing side wall to the second opposing side wall, wherein each of the first and second opposing side walls and the base wall, comprise i) an inside surface, which inside surfaces cooperate to form the inside of the body housing, and ii) an outside surface, which outside surfaces cooperate form the outside of the body housing;

an elongate slot formed in the base wall of the body housing, wherein the elongate slot extends between and through the first and second opposing side walls; a support body capable of carrying polishing material, wherein the support body is optionally removable; and a polishing surface alignment system for facilitating an alignment of the polishing material with the intermediate section which is independent of the alignment between the ice skate blade and the polishing apparatus as a whole;

the polishing surface alignment system comprising:

a cradle for receiving the support body, and which cradle is movable through a range between a first and a second position; and at least one, preferably at least two, and further preferably four, gimbal linkages each of which is adapted to cooperate with one, preferably one of at least two, and further preferably one of four, first pivot means and with one, preferably one of at least two, and further preferably one of four, second pivot means;

wherein the cradle is aligned with the longitudinal axis of the elongate slot and is adapted to be mounted inside the body housing between the inside surfaces of the first and second opposing side walls;

and wherein the at least one, preferably at least two, and further preferably four, gimbal linkages are adapted to facilitate movement of the cradle within the body housing between the first and second positions.

Preferably the polishing apparatus described above includes blade alignment guide means.

Advantageously the present invention provides a polishing apparatus as described above wherein two, of the at least two, preferably four, first pivot means are each attached to one of two portions of the cradle which are adjacent to the inside surface of the first opposing side wall and the other two of the four first pivot means are each attached to two portions of the cradle which are adjacent to the inside surface of the second opposing side wall; and wherein two of the four second pivot means provide pivotable attachment means for attaching at least one, preferably two of the four gimbal linkages to the inside surface of the first opposing side wall and the other two of the second four pivot means provide a pivotable attachment means for attaching the at least one, preferably the other two of the four gimbal linkages to the inside surface of the second opposing side wall.

A further preferred polishing apparatus as described above wherein the polishing surface alignment system is adapted to facilitate movement of the cradle between the first and second positions about a virtual pivot, wherein the position of the virtual pivot is located remotely of the outside surface of the base wall, and is aligned with the intersection between the longitudinal axis of the elongate slot and the midpoint between the first and second opposing side walls.

The advantages provided by the above described cradle and first and second pivot means permit the cradle and the polishing surface attached thereto to move through a range between a first and a second position preferably substantially about an axis parallel to the axis of the skate blade so that the polishing surface tends to align with the intermediate surface as the intermediate surface is rotated about its long axis.

To assist in sliding the running base within the elongate slot when the polishing apparatus as described above is in use, rolling elements are provided on opposing sides of the elongate slot. Conveniently, the rolling elements described above comprise two or more wheels which are mounted within the housing body and which are each independently adapted for rotation about a respective central axis and preferably this axis is perpendicular to the longitudinal axis of the elongate slot.

In this particularly preferred embodiment of the present invention relative movement between the polishing surface and the intermediate section may be provided as described above. Further it is advantageous to employ an actuation device for driving reciprocating (vibratory) movement of the support body carrying the polishing surface, relative to the cradle. Desirably, the reciprocating movement is in a direction parallel with the longitudinal axis of the elongate slot.

The features and alternatives described above, particularly in relation to the support body, the blade alignment guides, the polishing surface, the polishing material, the coated substrates, the removal facilitation means, the resilient means and the substrate body attachment means, are all directly applicable to use in relation to the apparatus of the fifth embodiment of the present invention.

It will be appreciated that the polishing surface alignment system which comprises: a cradle for receiving the support body, and which cradle is movable through a range between a first and a second position; and at least one preferably at least two, and further preferably four, gimbal linkages each of which is adapted to cooperate with one of at least two, preferably one of four, first pivot means and with one of at least two, preferably one of four, second pivot means;

wherein the cradle is aligned with the longitudinal axis of the elongate slot and is adapted to be mounted inside the body housing between the inside surfaces of the first and second opposing side walls;

and wherein the at least two, preferably four, gimbal linkages are adapted to facilitate movement of the cradle within the body housing between the first and second positions.

Preferably the polishing apparatus is further provided with a biasing spring, deflection of which results in the actuation of a switch.

It is also to be realised that features of the alignment system described above may also be useful in other treatment applications, for example devices for sharpening running bases, general blade sharpening and sanding, or any other application where it is essential to ensure alignment between the face of the object being treated and the surface which is performing the treatment.

BRIEF DESCRIPTION OF THE DRAWINGS

The present invention will now be described with reference to the following figures in which.

DETAILED DESCRIPTION

Figure 1:
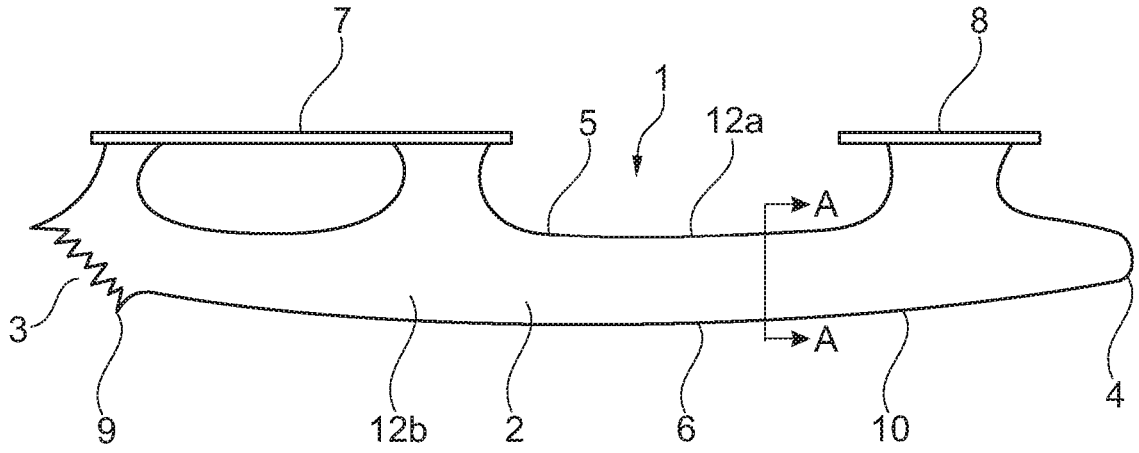
FIG. 1 schematically shows a side view of a representative blade for an ice skate.

Referring firstly to FIG. 1, there is shown a side view of a representative ice skate blade 1, which has a blade body 2 which has a forward end 3 towards the front of the blade body 2, a rearward end or tail 4 towards the back of the blade body 2, and opposing upper 5 and lower 6 portions of the blade body 2. The upper portion 5 has a toe plate 7 and a heel plate 8 through which fastening means (not shown) is used to secure the ice skate blade 1 to the underside of an ice skating boot (not shown). The lower portion 6 of the blade body 2 provides the blade edges 10 which, when the ice skate is in use, contact the surface of the ice. At the forward end 3 of the blade body 2 there is a toe rake 9 which helps the wearer of the ice skates to achieve, for example, jumps, spins and stops.

Figure 2A:
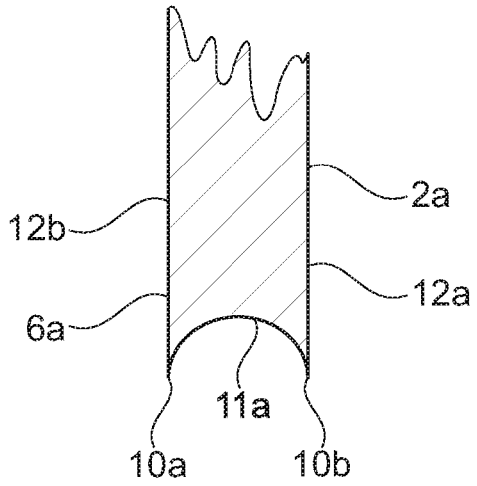
FIG. 2A shows a part cross section through the plane A-A in FIG. 1 of a representative blade for an ice skate typically used in figure skating or ice dancing.

FIG. 2A shows a part cross section through the plane A-A of a representative blade, as shown in FIG. 1, for an ice skate typically used in figure skating or ice dancing. The blade body 2*a* has a lower portion 6*a* that has two opposing blade edges 10*a*, 10*b* which are separated one from the other by an intermediate section 11*a*.

Figure 2B:
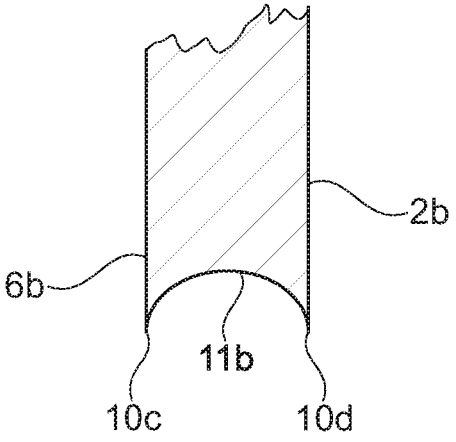
FIG. 2B shows a cross section through a corresponding plane A-A of a representative blade for an ice skate typically used in ice hockey.
Figure 2C:
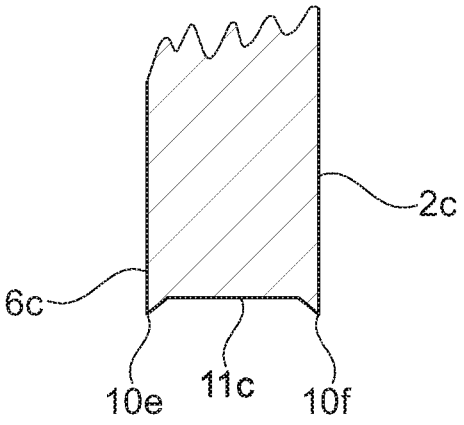
FIG. 2C shows a cross section through a corresponding plane A-A section of a representative blade for an alternative design of ice skate—a flat bottomed V grind profile, used in ice hockey.

FIGS. 2B and 2C shows a similar view to that in FIG. 2A except that the representative ice skate blades are those typically used in traditional ice hockey blade and a new design of ice hockey blade, respectively. In FIGS. 2B and 2C, the blade body 2*b*, 2*c* respectively, has a lower portion 6*b*, 6*c* respectively, that has two opposing blade edges 10*c*, 10*d* and 10*e*, 10*f*, respectively, which are separated one from the other by an intermediate section 11*b*, 11*c*, respectively.

The intermediate section 11*a*, 11*b* and 11*c* extends between and up to the respective two blade edges 10*a*, 10*b*, 10*c*, 10*d*, 10*e* and 10*f*, formed on the lower portions 6*a*, 6*b* and 6*c*, but does not include any part of the blade edges 10*a*, 10*b*, 10*c*, 10*d*, 10*e* and 10*f*.

Figure 3:
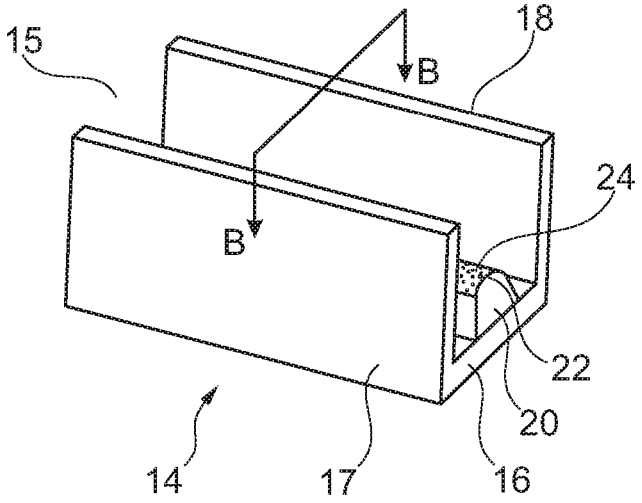
FIG. 3 shows a perspective view of a handheld polishing apparatus according to a first embodiment of the present invention.

FIG. 3 shows a perspective view of a handheld polishing apparatus 14 according to a first embodiment of the present invention. The apparatus has an elongate and open ended square "U"-shaped blade-receiving channel 15 formed by two opposing parallel walls which form first and second blade alignment guides 17,18 respectively that upstand perpendicularly from, and are separated one from the other by, a horizontal base 16. The horizontal base 16 has a raised elongate ridge-like support body 20 formed on it, which runs coaxially with the longitudinal axis of the elongate blade-receiving channel 15. The apex of the ridge-like support body 20 provides a polishing surface 22 and has polishing material 24 disposed thereon. The polishing surface 22 is also adapted to have an external profile that corresponds with the profile of the intermediate section 11 between and up to, but not including any part of, the two blade edges 10 which are located on the lower portion 6 of the blade body 2 of the ice skate blade to be polished.

Figure 4:
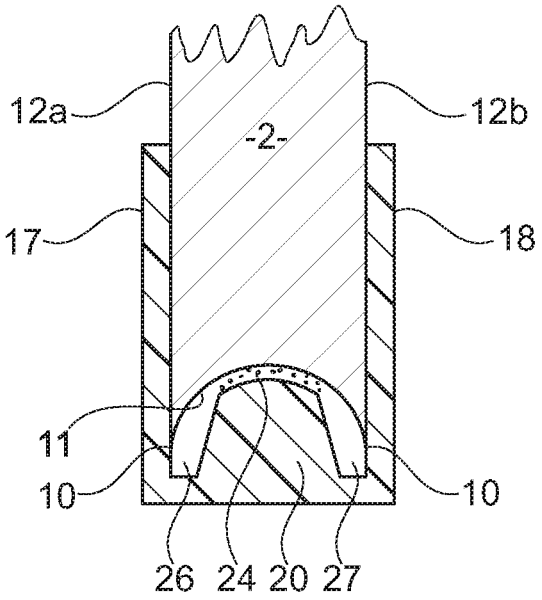
FIG. 4 shows a cross section of the apparatus shown in FIG. 3 through the plane B-B when it is in use together with the representative ice skate blade as shown in FIG. 2B, the latter also shown in cross section along a corresponding plane A-A.

FIG. 4 shows a cross section of the apparatus shown in FIG. 3 through the plane B-B when it is in use together with the representative blade shown in FIG. 2B, the latter also shown in cross section along a plane corresponding to A-A. As can be seen, the first and second blade alignment guides 17, 18 serve to constrain the orientation of the blade body 2 by contacting the outer surfaces 12*a*, 12*b* of the blade body 2. In this way, the polishing material 24 on the polishing surface 22 can be ensured to contact the intermediate section 11 between and up to, but not including any portion of, the two blade edges 10. The apparatus 14 further includes two edge relief channels 26, 27 which assist to ensure that no part of the two blade edges 10 are contacted by the polishing surface 22 and/or the polishing material 24. The two edge relief channels 26 and 27 are each formed by an elongate void and each channel has an axis that runs parallel to the axis of the blade receiving channel 15. Specifically, edge relief channel 26 is located between the first blade alignment guide 17 and the support body 20, and edge relief channel 27 is located between the second alignment guide 18 and the support body 20.

When the apparatus 14 is in use, a section of the lower portion 6 of a blade body 2 of an ice skate blade 1 is inserted into the blade receiving channel 15; in so doing, the orientation of the blade body 2 is constrained by the first and second blade alignment guides 17, 18. The operator then pushes the blade body 2 towards the polishing surface 22 so that the intermediate section 11 between and up to, but not including any portion of, the two blade edges 10, comes into contact with the polishing material 24 on the polishing surface 22. Whilst this contact is maintained, the user moves the polishing apparatus 14, in a stroking motion that is guided by the first and second blade alignment guides 17 and 18, along the lower portion 6 of the blade body 2, to and fro between the forward end 3 and the rearward end 4 of the blade body 2. In this way, the apparatus achieves a polished mirror finish on the intermediate section 11 which is between and up to, but not including any portion of, the two blade edges 10.

Figure 5A:
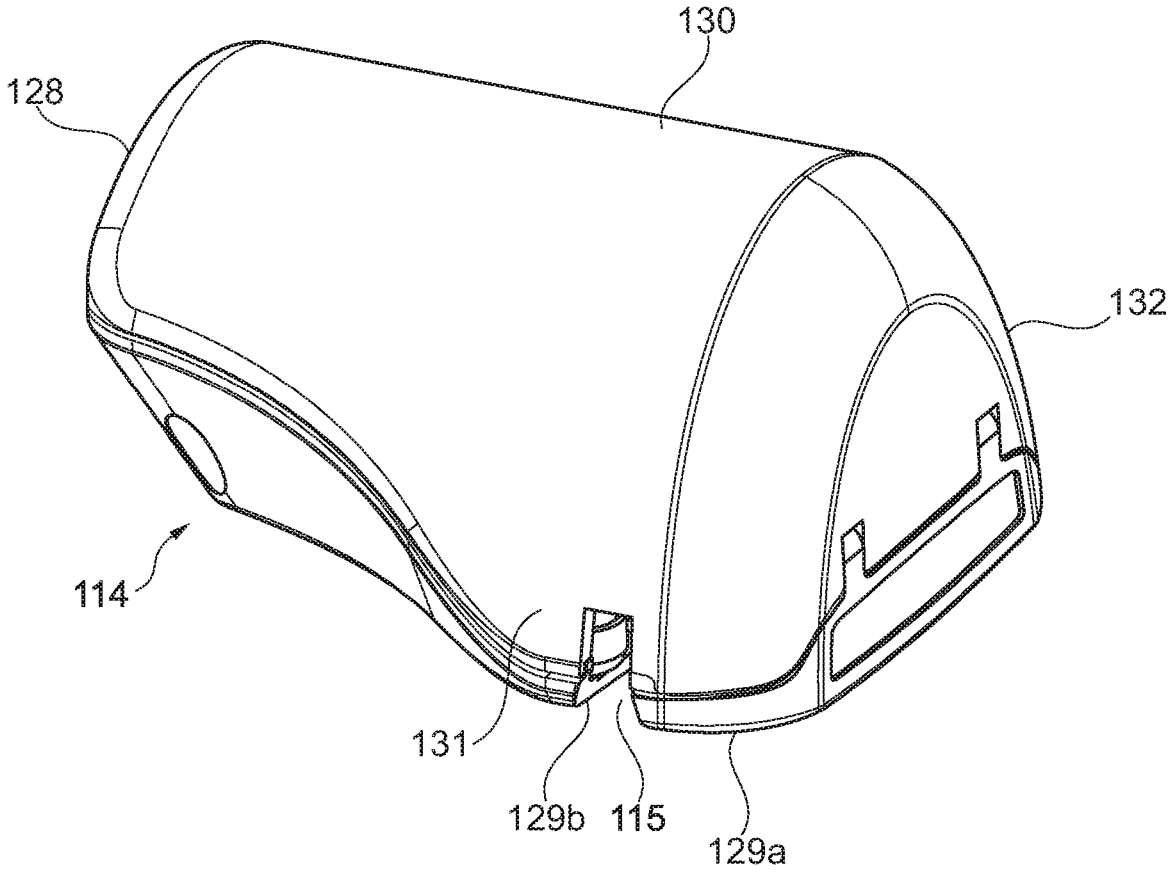
FIG. 5A shows a perspective view of the topside of a handheld polishing apparatus according to a seventh embodiment of the present invention.
Figure 5B:
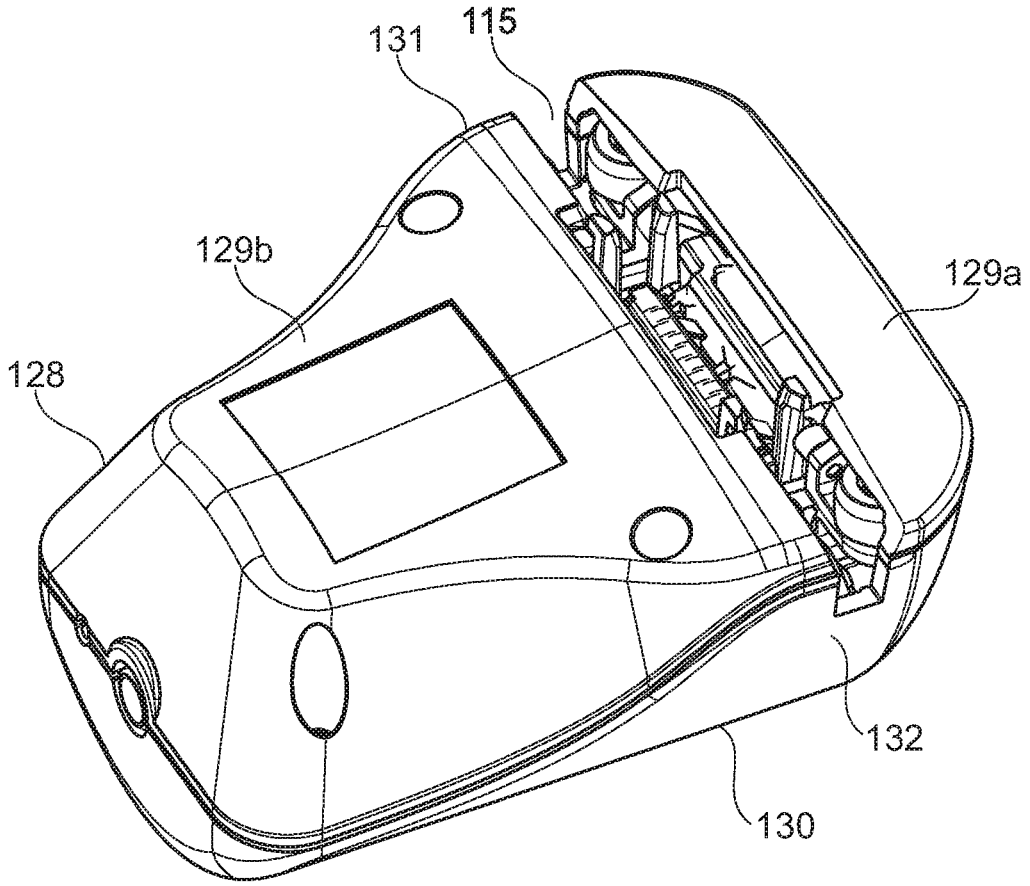
FIG. 5B shows a perspective view of the underside of the handheld polishing apparatus shown in FIG. 5A.

FIG. 5A shows a perspective view of the top side of a handheld polishing apparatus 114 according to a second embodiment of the present invention. The apparatus 114 comprises a housing 128, formed by two base portions 129*a* and 129*b* and a top portion 130. The top portion 130 has a generally dome-shaped profile, with opposing first and second side regions 131, 132. FIG. 5B illustrates the underside of the apparatus 114, and shows the presence of an elongate and open ended generally square "U"-shaped blade receiving channel 115 that is formed between the base portions 129*a* and 129*b* of the housing 128. As can be seen, this channel 115 extends between and through the first and second side regions 131, 132 of the top portion 130.

Figure 6A:
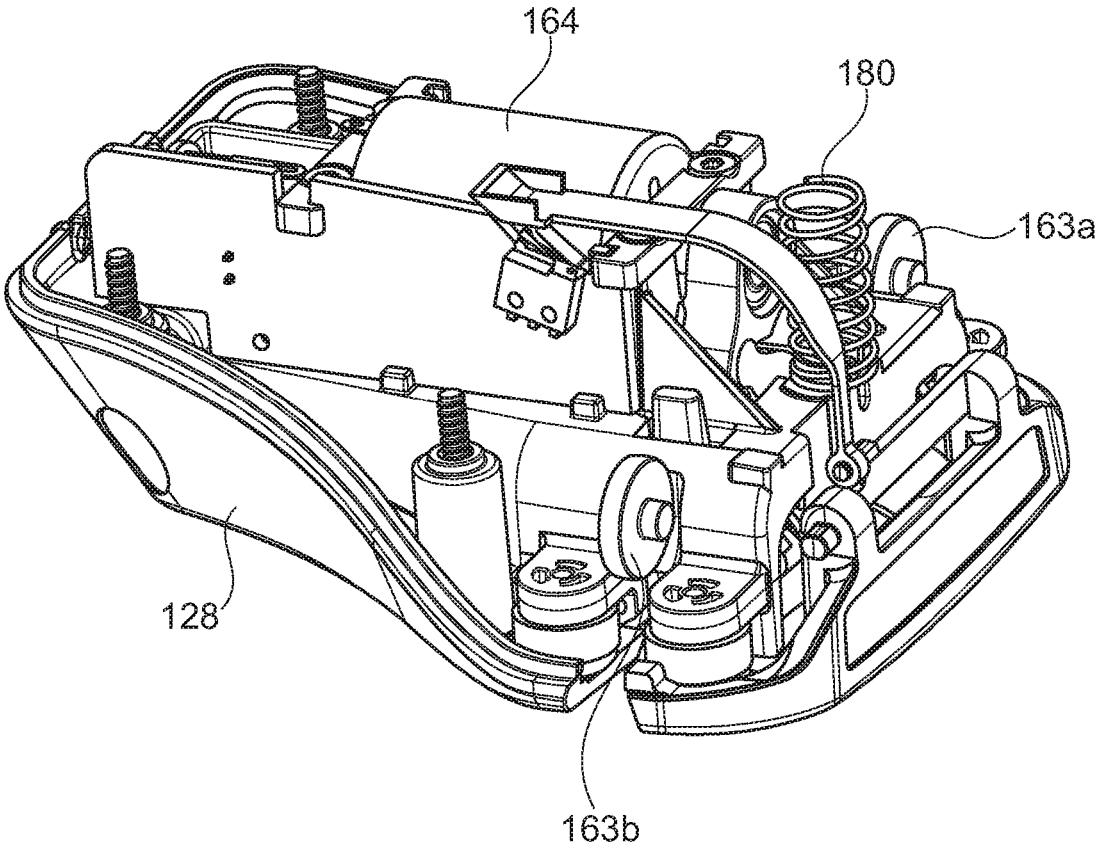
FIG. 6A shows the same perspective view of the topside of the handheld polishing apparatus shown in FIG. 5A except that the top section of the apparatus housing has been removed to reveal the inside mechanism of the polishing apparatus in more detail.
Figure 6B:
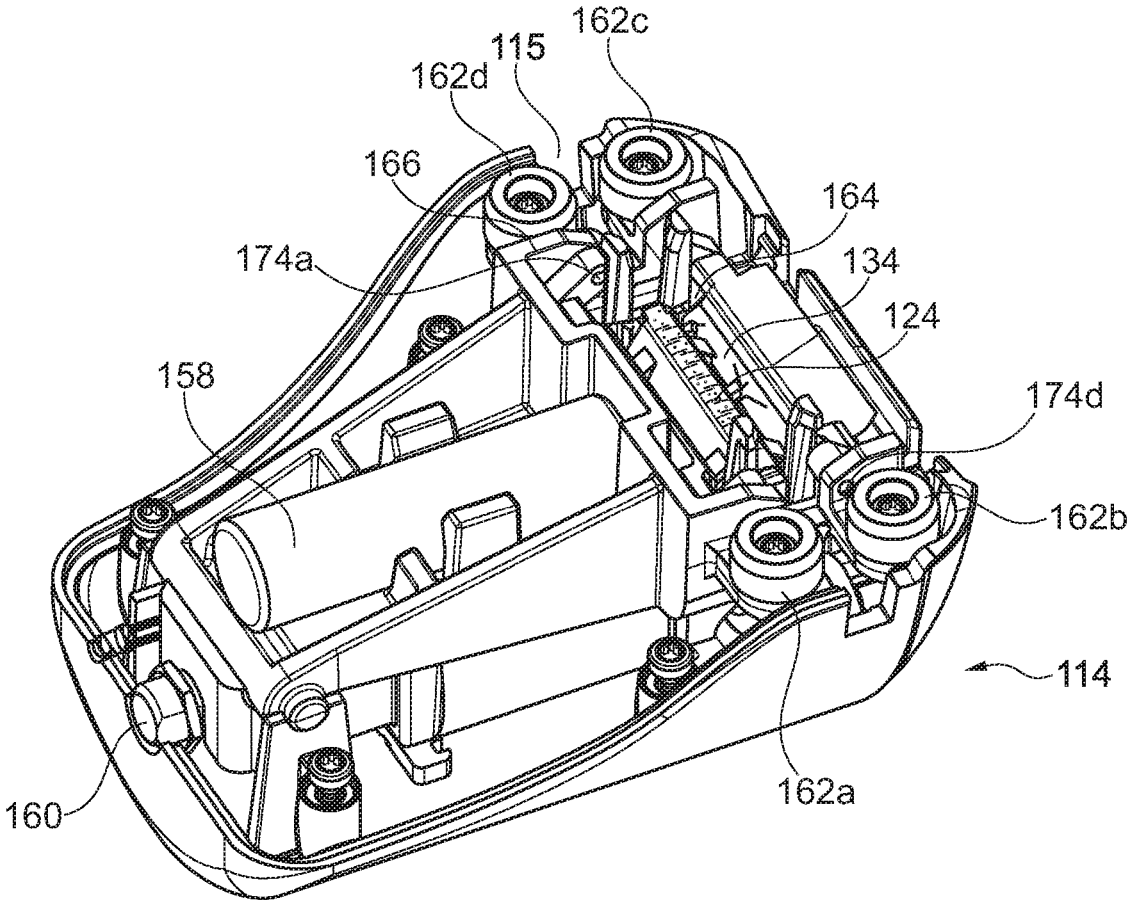
FIG. 6B shows the same perspective view of the underside of the hand held apparatus shown in FIG. 5B except that the base section of the apparatus housing has been removed to reveal the inside mechanism of the polishing apparatus in more detail.

FIG. 6B illustrates the apparatus 114 shown in FIG. 5B, except that the base portions 129*a* and 129*b* of the housing 128 have been removed so that the internal structure of the blade receiving channel 115 can be seen more clearly. In particular, FIG. 6B shows that the apparatus 114 includes a cartridge 134 which carries polishing material 124 and which cartridge is positioned within, and removable from, the elongate channel 115.

Figure 7:
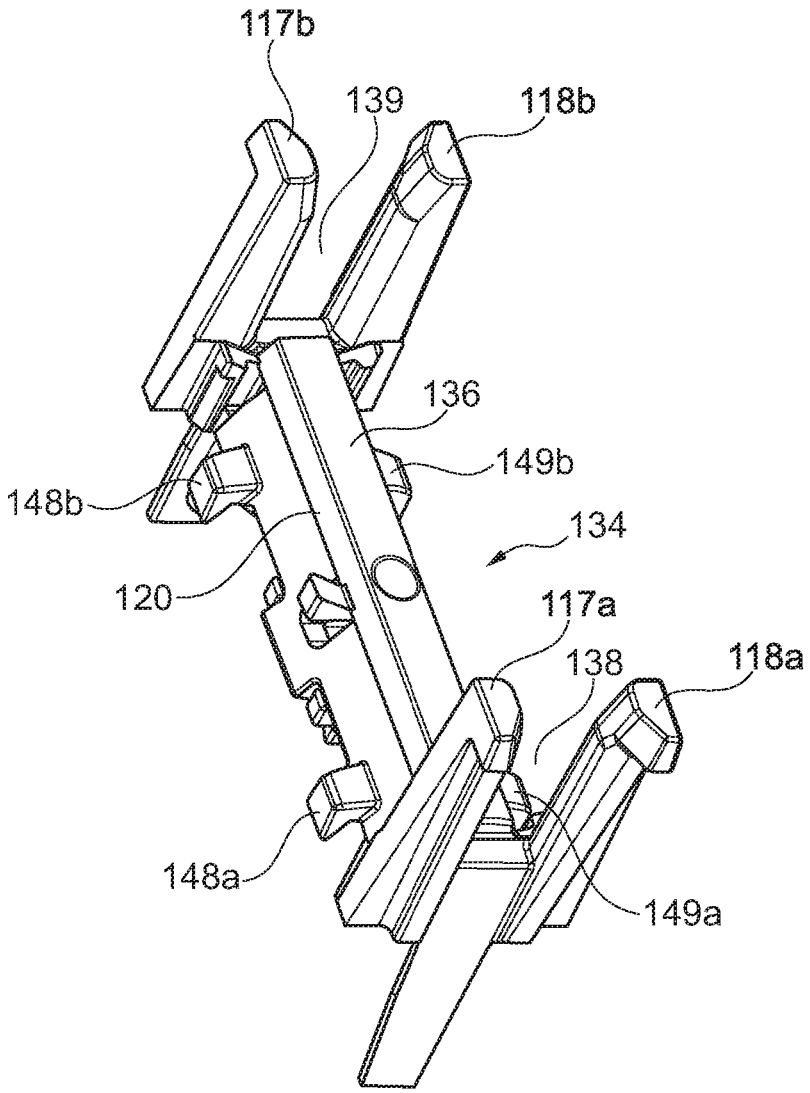
FIG. 7 shows a perspective view of a removable cartridge with a polishing surface for use in the polishing apparatus of the present invention.

As shown in FIG. 7, the removable cartridge 134 has a central beam 136 with a forward end 138 and a rearward end 139. One pair of opposing first and second blade alignment guides 117*a*, 118*a* are located at the forward end 138 and another pair of opposing first and second blade alignment guides 117*b*, 118*b* are located at the rearward end 139, of the central beam 136. Each of the alignment guides 117*a*, 118*a*, 117*b* and 118*b* upstand perpendicular relative to the longitudinal axis of the central beam 136. Further, the two opposing alignment guides in the first pair 117*a*, 118*a* are separated one from the other by a distance greater than the width of the top portion of the central beam 136 at its forward end 138 and the two opposing alignment guides in the second pair 117*b*, 118*b* are separated one from the other by a distance greater than the width of the top portion of the central beam 136 at its rearward end 139.

Figure 8:
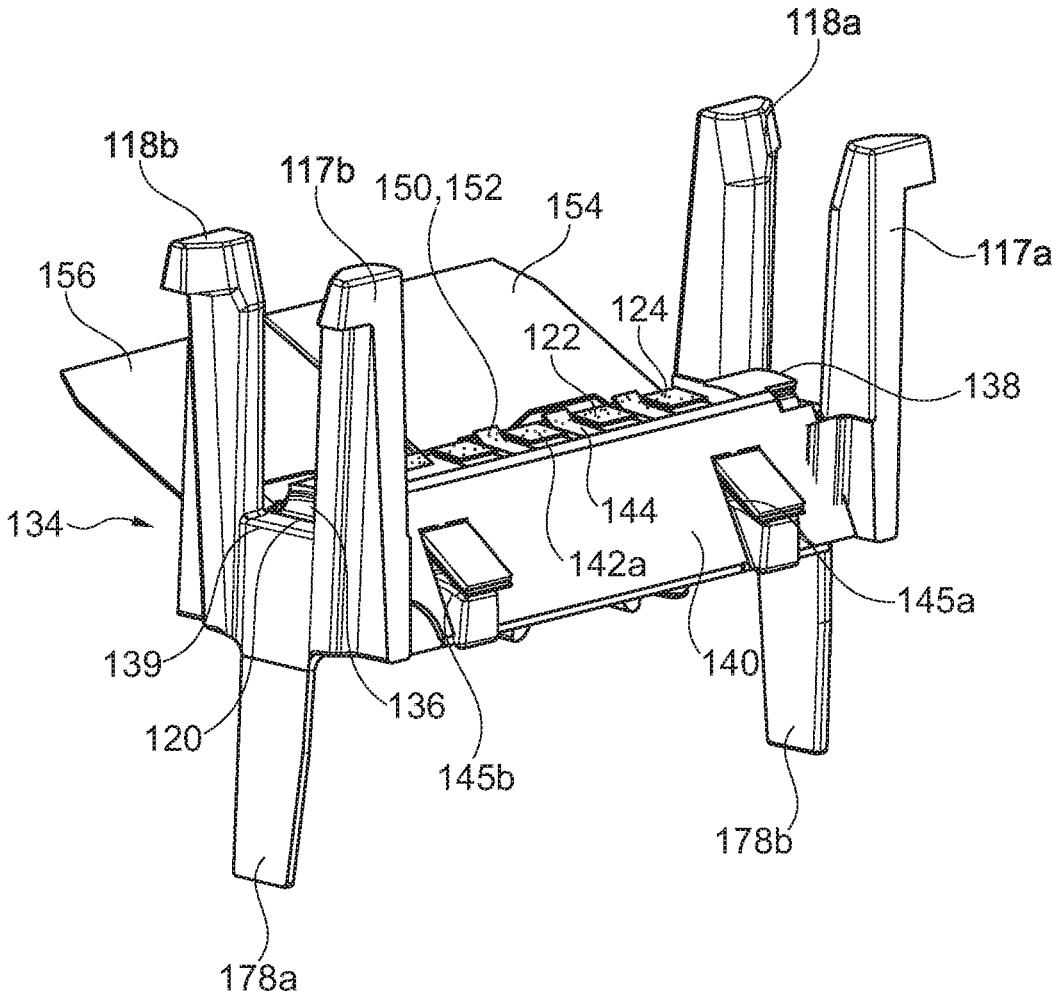
FIG. 8 shows the removable cartridge depicted in FIG. 7 with polishing material supported by the polishing surface.

As shown in FIG. 7, the central beam 136 of the cartridge 134 has a raised elongate ridge-shaped support body 120 which runs coaxially with the longitudinal axis of the central beam 136. The purpose of the support body 120 is to carry polishing material 124, as shown in FIG. 8. The polishing material 124 can, for example, be disposed directly into the support body 120, or, as shown in FIG. 8, be coated onto sheets of a substrate material 140, 142*a* and 142*b* (not shown) which are overlaid and aligned one with the other in a stack 143 (not shown) that is carried by the support body 120. The topmost surface 144 of the polishing material 124 of the topmost substrate material 140 in the stack 143 (not shown) provides a polishing surface 122 which has an external profile which corresponds with the profile of the intermediate section 11 between and up to, but not including any part of, the two blade edges 10 which are located on the lower portion 6 of the blade body 2 of the ice skate blade to be polished.

Also as seen in FIG. 8, each of the overlaid and aligned coated sheets of substrate material 140, 142*a*, 142*b* (not shown) has a first pair of slots 145*a*, 145*b* on one side of the central beam 136, and a corresponding second pair of slots 146*a*, 146*b* (not shown) on the other side of the central beam 136.

The overlaid and aligned coated sheets of substrate material 140, 142*a*, 142*b* (not shown) are retained by the support body 120 as follows. The coated sheets of substrate material are similar to each other, and when they are overlaid and aligned with one another, each slot 145*a*, 145*b*, 146*a* (not shown), 146*b* (not shown) in a first coated sheet of substrate material 140 is aligned with the slots that are in identical positions in all of the coated sheets of substrate material being overlaid. Referring again to FIG. 7, the cartridge 134 has a first pair of clips, 148*a*, 148*b*, which are spaced one from the other and are located along the same long side of the central beam 136. The cartridge 134 also has a second pair of clips 149*a*, 149*b*, which are positioned along the other long side of the central beam 136, so that the position of each clip in the second pair 149*a*, 149*b* opposes the clips in the first pair 148*a*, 148*b* respectively. Each of the clips 148*a*, 148*b*, 149*a*, 149*b* protrude from their respective side of the central beam 136, and are adapted to be received by one of the aligned slots 145*a*, 145*b* in the aligned stack 143 of aligned coated sheets of substrate material 140, 142*a*, 142*b* (not shown).

A further feature of the coated sheets of substrate material 140, 142*a*, 142*b* (not shown) is that they are each cut with an interlocking pattern 150. This forms a series of raised interlocking finger-shaped sections 152 which protrude from the coated surface of the substrate material 140 when the coated sheet of substrate material 140 is folded sub-horizontally over the central beam 136 of the cartridge 134. It is these raised interlocking finger-shaped sections 152 which provide the polishing surface 122 which engages with, and thereby achieves the polished mirror finish on, one or more portions of the intermediate section 11, particularly the portions that are between and up to, but not including any portion of, the two blade edges 10 of the ice skate blade 1. The finger-shaped sections 152 are slightly resiliently deformable when pressed upon, and thereby, in use, resiliently deflect the polishing surface 122 towards the intermediate section 11. Thus, the polishing surface 122 as disposed on the finger sections 152 remains in contact with the intermediate section 11 when the apparatus 114 is in use.

FIG. 8 illustrates that the coated sheets of substrate material 140,142*a*, 142*b* (not shown) each have a tab portion 154, 156, present in connection with coated sheet 140 and 142*a* respectively, which is designed to be gripped between the forefinger and thumb of the user of the apparatus 114 and pulled sharply away from the support body 120 so as to tear the topmost coated sheet of substrate material 140 from the stack 143, to reveal the next successive coated sheet of substrate material 142*a*. Substrate material 142*b* is the bottom most coated sheet of substrate material and it does not have a tab portion; there will be no need to remove this bottom most coated sheet from the support body because there is no next successive coated sheet of substrate material which is able to be revealed.

Referring back to FIG. 6B, the apparatus 114 is also provided with a rechargeable battery 158, and a power input socket 160 through which the apparatus 114 can be connected to an external power source to charge the battery 158.

FIG. 6B further shows four rolling guide wheels 162*a*, 162*b*, 162*c* and 162*d* which are mounted in first and second opposing pairs on either side of the blade receiving channel 115. The rolling guide wheels 162*a*, 162*b*, 162*c* and 162*d* each have an axis of rotation that is perpendicular to the longitudinal axis of the blade receiving channel 115, and their function is to engage with and roll over the opposing outer surfaces 12*a* and 12*b* of the blade body 2 by rotating about their respective axis of rotation as the blade body 2 is moved to and fro during the polishing operation as described above. The guide wheels 162*a*, 162*b*, 162*c* and 162*d* are particularly useful to assist in guiding the skate body 2 smoothly within the blade receiving channel 115 during the polishing operation. They provide gross alignment of the apparatus and prevent high forces from being applied to the cartridge. In addition to the above described rolling guide, FIG. 6A also shows that two further rolling guides 163*a* and 163*b* are also provided, and which are oriented so their axis of rotation is also perpendicular to the longitudinal axis of the blade in the receiving channel 115 but also perpendicular to the axis of rotation of rolling guides 162*a-d*, such that the axis of rotation for the rolling guides 162*a-d* and rolling guides 163*a-b*, and the longitudinal axis of blade receiving channel 115, are mutually three-way perpendicular to each other. The purpose of the rolling guides 163*a* and 163*b* is to help to control the movement of the blade in the blade receiving channel and to remove load being exerted on the bottom slot, and in turn prevent high forces being transmitted to the cartridge in a perpendicular direction to the rolling guides 162*a-d*.

A further important feature of the present invention is the provision of a polishing surface alignment system 164 which not only aligns the polishing surface 122 with the intermediate section 11 of the blade body 2 (i.e. it ensures that no part of the two opposing edges 10 of the blade body 2 are also contacted by the polishing surface 122), but also the polishing surface alignment system 164 ensures that this alignment (between polishing surface 122 and intermediate section 11) is independent of the orientation of the running base blade 1 relative to the polishing apparatus 114 as a whole.

Figure 9:
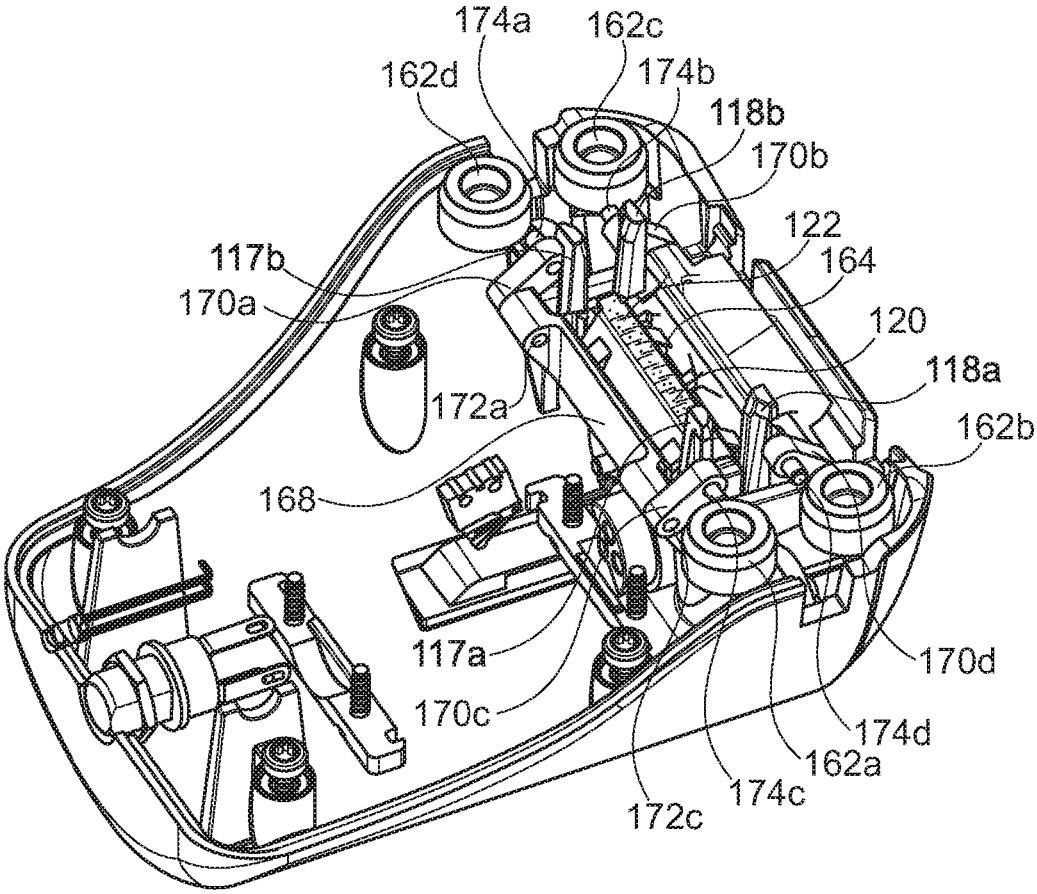
FIG. 9 shows the handheld polishing apparatus as shown in FIG. 6B with some of the elements of the inside mechanism removed in order to reveal a blade alignment system in detail.

Looking again at FIG. 6B in conjunction with FIG. 9, these Figures show a gimbal frame 166 which carries a cradle 168 which, in turn, receives the support body 120. FIG. 9 in particular shows the same view of the apparatus 114 as illustrated in FIG. 6B, except that the gimbal frame 166 and battery 158 have been removed to more clearly reveal the mechanism by which the cradle 168 is attached to the gimbal frame 166. The cradle 168 is moveable between first and second positions about a virtual pivot point (not shown). Specifically, this virtual pivot point is located remotely of the outside surface of the base portions 129*a* and 129*b* of the apparatus housing 128, and is aligned with the point of intersection between the longitudinal axis of the blade receiving channel 115 and the midpoint between the first and second pairs of blade alignment guides 117*a*, 118*a* and 117*b*, 118*b*, respectively. The movement of the cradle 168 between first and second positions is enabled by four gimbal linkages 170*a*, 170*b*, 170*c*, 170*d*, each of which cooperate firstly with one of four first pivot means 172*a*,

172*b*, 172*c*, 172*d*, and secondly with one of four second pivot means 174*a*, 174*b*, 174*c*, 174*d*. The second first pivot means 174*a*, 174*b*, 174*c*, 174*d* are pivotally attached to the gimbal frame 166 (as shown in FIG. 6B), and enable the cradle 168 to hang from the gimbal frame 166 and swing about the virtual pivot point (not shown). Thus, when the apparatus 114 is in use, since the polishing surface 122 (as supported by support body 120) is mounted within the cradle 168, it swings with the cradle 168 between the first and second positions of the cradle 168, and the polishing surface 122 is maintained in contact with the central portion of the intermediate section 11 independently of the orientation of the skate blade 1 relative to the apparatus 114 as a whole.

As shown in FIG. 6A the polishing apparatus 114 has a motor 164 which, when actuated, drives reciprocating movement of the support body 120 and its associated polishing material 124 relative to the cradle 168, in a direction of movement that is parallel to the longitudinal axis of the blade receiving channel 115.

Referring to FIG. 8, the removable cartridge 134 has a pair of flexures 178*a*, 178*b* which are elongate leg members which are substantially parallel with, but extend in a direction diametrically opposite to that of, the blade alignment guides 117*a*, 117*b*, 118*a*, 118*b*. An important purpose of the flexures 178*a*, 178*b* is to provide means by which to seat the removable cartridge 134 within the cradle 168 whilst permitting it to reciprocate parallel to the skate blade.

A further feature of the apparatus of the present invention as shown in FIG. 6A, is the provision of a gimbal frame which is i) pivotably mounted within the apparatus, and ii) biased by a spring 180. Applying load via the cartridge to the gimbal frame causes a deflection which is used to actuate a switch 182 that activates the motor when sufficient load is applied. Thus, spring 180 controls the pressure at the workface over a limited range, and the switch 182 will not operate until the spring 180 is compressed by at least a certain amount in order to ensure that no polishing occurs until there is sufficient force to activate the motor. This prevents the abrasives moving about in an uncontrolled fashion, and also ensures that the cartridge will tend to self-centre into the radius of hollow, as it needs to be pressed into the radius of hollow before it starts reciprocating. The spring 180 is chosen to be relatively hard and when mounted in the polishing apparatus it is not fully compressed, so that when a skate is inserted between the opposing blade alignment guide means and pushed too hard, the skate engages with the wheels 163*a* and 163*b* as a result, the force exerted on the polishing surface by the blade is governed by the compression of the spring 180.

Various optional features of the invention have been described above in particular combinations by way of example only, such optional features may be combined in other ways without restriction to the scope of the invention, which is defined by the appended claims.

The invention claimed is:

1. Polishing apparatus for polishing an intermediate section of a running base of a skate blade, the skate blade comprises a blade with two opposing blade edges which are separated one from the other by the intermediate section, the polishing apparatus comprising:

a body housing comprising at least a first and a second opposing side wall and a third base wall which extends between and links the first opposing side wall to the second opposing side wall, wherein the first and second opposing side walls and the base wall each comprise an inside surface which inside surfaces cooperate to form the inside of the body housing, and an outside surface which outside surfaces cooperate to form the outside of the body housing;

an elongate slot formed in the base wall of the body housing, wherein the elongate slot extends between and through the first and second opposing side walls;

a support body carrying polishing material having a polishing surface; and an alignment system disposed within the elongate slot of the housing for facilitating alignment of the support body, including the polishing material, with the intermediate section of the blade;

the alignment system comprising:

a cradle for receiving the support body, and which cradle is movable between a first and a second position; and at least one gimbal linkage mounted within the housing which is adapted to cooperate with a first pivot means and with a second pivot means;

wherein the cradle is aligned with the longitudinal axis of the elongate slot and is mounted inside the body housing between the inside surfaces of the first and second opposing side walls;

and wherein the at least one gimbal linkage is adapted to facilitate movement of the cradle and the support body within the body housing between the first and second positions via the first and second pivot means to thereby align the support body, including the polishing material, with the intermediate section of the skate blade but not any part of the two opposing blade edges of the running base during polishing.

2. The polishing apparatus according to claim 1 wherein the polishing surface comprises a plurality of coated sheets which are overlaid one on top of the other in a stack which is adapted to be carried by the support body.

3. The polishing apparatus according to claim 2 wherein one or more of the plurality of coated sheets are removable from the support body, and optionally one or more of the plurality of coated sheets are replaceable with one or more further coated sheets.

4. The polishing apparatus according to claim 2 wherein each of the plurality of coated sheets comprises a thin sheet material coated on a first surface which provides the polishing surface.

5. The polishing apparatus according to claim 2 wherein the polishing surface is associated with resilient means for resiliently deflecting the polishing surface towards the intermediate section between the two opposing blade edges of the running base.

6. The polishing apparatus according to claim 5 wherein the resilient means comprises a deformable material disposed between the support body and the polishing surface.

7. The polishing apparatus according to claim 4 wherein the polishing surface has raised polishing elements that are adapted to be resiliently deformable when they engage one or more portions of the intermediate section between the two opposing blade edges of the running base.

8. The polishing apparatus according to claim 1 further comprising an actuation device for driving reciprocating relative motion between the polishing surface and the intermediate section.

9. The polishing apparatus according to claim 4 wherein at least one of the coated sheets comprises a pattern that is cut therein, the cut pattern is such that when opposing edges of the at least one coated sheet comprising the cut pattern are folded in a direction away from the coated first surface, one or more raised polishing elements are adapted to protrude from the coated first surface of the respective folded cut coated sheet.

* * * * *